United States Patent [19]

Whitmer

[11] Patent Number: 5,029,670

[45] Date of Patent: Jul. 9, 1991

[54] FRAME ERECTION SAFETY SYSTEM AND COMPONENTS THEREOF

[76] Inventor: Gerald T. Whitmer, Route 1, Box 33, Shenandoah Junction, W. Va. 25442

[21] Appl. No.: 542,106

[22] Filed: Jun. 22, 1990

[51] Int. Cl.[5] ..... B21F 27/00; A62B 35/00; E04G 21/32

[52] U.S. Cl. ..... 182/113; 182/3; 256/53

[58] Field of Search ..... 182/3, 5, 6, 7, 112, 182/113; 248/228; 256/59, 53, 65

[56] References Cited

U.S. PATENT DOCUMENTS 4,037,824 7/1977 Whitmer ..... 256/53

4,052,028 10/1977 Cordero ..... 248/228

4,799,639 1/1989 Riley ..... 248/228

*Primary Examiner*—Reinaldo P. Machado

*Attorney, Agent, or Firm*—Staas & Halsey

[57] ABSTRACT

The specification discloses a removable safety system for construction workers which is mounted on an I beam which provides a cable hand hold to which a safety lanyard may be fastened. The ends of the cable are terminated by a special device that increases the grip of the device on the beam when a load is applied.

The safety system may be installed on the I beam at ground level and hoisted with the I beam as it is positioned for attachment to a building or bridge.

8 Claims, 2 Drawing Sheets

FRAME ERECTION SAFETY SYSTEM AND COMPONENTS THEREOF

This invention relates to a safety system and its components for erecting the steel frames of buildings which provides the steel worker with a safety cable hand hold as well as a point to which a safety lanyard can be fastened.

This invention is an improvement on the inventor's safety post as set forth in U.S. Pat. No. 4,037,824.

As is well known, working on steel beams during the construction and maintenance of buildings, bridges and the like can result in dangerous falls which result in injury and even death. A common safety measure to provide a safety under these conditions are to provide nets deployed under the workers to catch them in the event of a fall. These nets are usually difficult to deploy and expensive to use. An improved apparatus providing a personal fall arrest system is shown in the inventor's U.S. Pat. No. 4,037,824 is being increasingly used. However, that patent utilized as a termination for the safety line cable, various bolt holes and the like in the beams that are used for bolting or riveting the erected steel in place. Beams used in bridges usually contained plenty of bolt holes but in a lot of applications no bolt holes were available for the termination and even in bridges, the bolt holes are needed to bolt or rivet the construction members together.

The present invention provides a system which includes a safety line cable termination arrangement which does not require bolt holes for the termination and also permits the placement of the safety system on the construction beam while it is still on the ground since no bolt holes are required which are necessary for holding the construction beam in place once it is hoisted. The prior system as shown in the patent wouldn't permit installation on the ground before erection in many cases because the bolt hole utilized may be needed for a connection.

The present invention utilizes a system for personal safety that includes a termination of the safety line cable by a sliding clamping device that when tightened holds it on to the flange of an I beam by a wedging and clamping arrangement. When the system is utilized to arrest a construction workers fall, the clamping forces are increased due to a leveraging force tightening the clamping means onto the flange. The system includes two or more safety posts or stanchions for holding safety line securing cables to which a safety lanyard attached to the work person may be fastened. The safety line cables are held at the top of the stanchion by a pair of arcuate horns that permits an individual stanchion to be removed on the safety line cable without removing other stanchions and also permits the lanyard to maintain continuous connection to the safety line cable while being slid along the cable past the stanchions without having to be disconnected from the cable. Upon an accidental fall, the construction worker will have his or her fall arrested by the lanyard fastened to the safety line cable and to the worker's body. This safety system and its components provides a safety arrangement which is economical to manufacturer, ship, purchase and deploy and which permits great freedom of movement of the person using the system and yet provides adequate safety in the event of an accidental fall.

BRIEF DESCRIPTION OF THE DRAWINGS

The above complete description of the invention will become more readily apparent on reading the following description including the drawings:

With reference to FIG. 1 there is shown a stanchion support clamping assembly 10 and a cable termination clamping assembly 12. Both assemblies are shown clamped to the flanges of an I beam 14 which is a common type of structural or construction beam used in steel work for bridges, buildings and alike. The stanchion support clamping assembly includes a pair of parallel fixed clamping jaws 16 welded to one end of a horizontal support 18 preferably in the form of a channel which rests on the top surface of the I beam 14. At the other end of the horizontal support are a pair of movable clamping jaws 20 which are integral with a sliding jaw clamping assembly 22 which also includes an upper cross piece 24, a cylindrical steel rod 26 welded at each end to the assembly and two clamping screws 28. Also provided is a stop 30 in the form of a through bolt extending across the horizontal support 18 and held in place by a lock nut.

Figure 1:
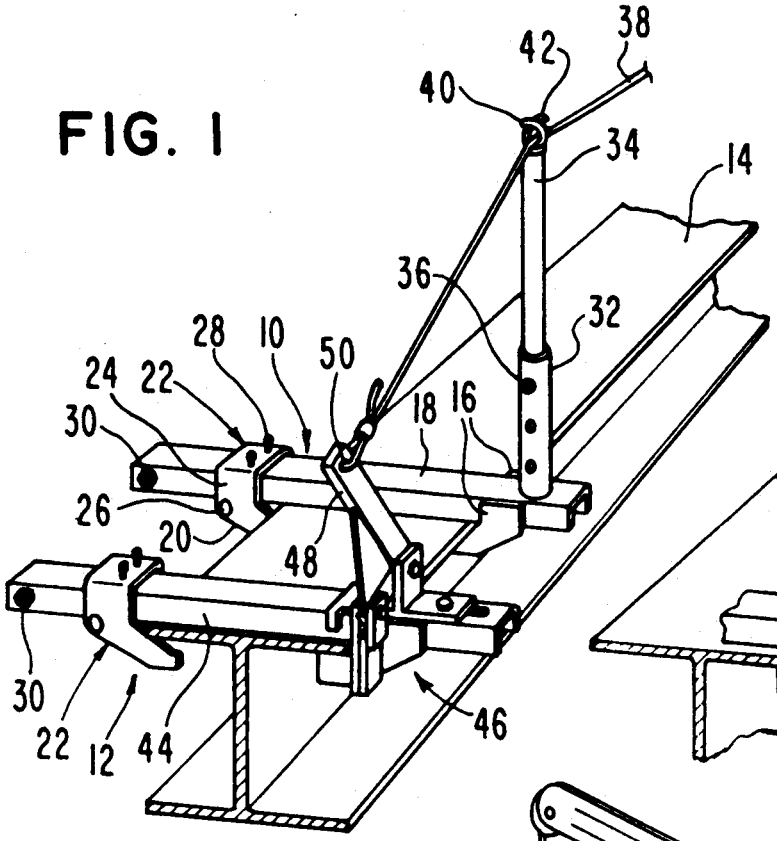
FIG. 1 is an elevational perspective view showing one and of the safety system with the remainder of the system being broken away and the I beam shown in cross section.

Clamping of the stanchion support clamping assembly to the I beam is achieved by placing the horizontal support on top of the I beam as shown in FIG. 1 and moving the slidable jaw clamping assembly as far as possible in the direction of the fixed clamping jaws and then tightening the clamping screws 28. Tightening of the clamping screws rotates the slidable clamping jaws 20 upward to increase the clamping force. It is to be noted that the clamping screws 28 are inboard of the cylindrical steel rod 26 about which the slidable clamping jaws rotate upward. It is also to be noted that the part of the slidable clamping jaws as well as the part of the fixed clamping jaws that contact the flange of the I beam are on an incline which defines different thicknesses of flanges of I beams to be accommodated. For example, a thin flange would cause the clamping to be high up on the incline, whereas a thick flange would cause the clamping to occur lower down on the incline. The incline is provided to accommodate all the thicknesses of flanges normally encountered.

The stanchion support clamping assembly 10 has a stanchion socket 32 with a series of holes therein. The stanchion 34 has complementary holes therein (not shown) which may be lined up with the holes in the stanchion socket and held in place by a pin 36. When the pin 36 is removed the height of the stanchion can be adjusted in the socket by moving up or down and the pin positioned in a new set of holes. The adjustability is an optional feature and is not shown in the FIG. 2 embodiment. The inventor prefers a 36" height because it is easier to use when walking the beam and deploying the lanyard continuously fastened to the safety line cable and still provide a handrail offering substantial fall protection. However, some safety experts feel that a 42" height of a hand rail or safety line cable is a preferred height. Iron workers usually have tools and implements strapped to their waist and since the safety system of the present invention does not require the unsnapping and resnapping of the lanyards when passing a stanchion it is more difficult to use the 42" as opposed to the 36" height.

The reason the lanyard does not have to be removed from the safety line cable 38 is because the safety line cable is held on the top stanchion 34 by a pair of arcuate horns 40 and 42 which overlap to form a "ring" shape. The horn 40 is spaced apart from horn 42 so that the fastener on the end of the lanyard connected to the worker can be continuously held by the safety line cable 38 and not have to be snapped or unsnapped when passed from one side of the stanchion to the other. This is described in the inventor's prior U.S. Pat. No. 4,037,824 which is incorporated in its entirety in this disclosure by reference. When the moveable or slidable jaw clamping assembly is loosened, it is free to slide along the horizontal support 18. To prevent it falling off the end of the support the stop 30 is provided. The stop 30 is a protruding bolt that is held on by a friction type of protruding nut so it can be removed when it is desired to remove the slidable clamping jaw 20.

The cable termination clamping assembly 12 has a similar slidable jaw clamping assembly 22 and stop 30 mounted on one end of horizontal support 44. At the other end of the horizontal support 44 there is provided a moveable or sliding termination clamping assembly 46 which will be more fully described with reference to FIGS. 5–8 infra. The termination clamping assembly 46 includes a pivoting upright lever or link 48 containing an opening 50 near its most elevated end. In this opening 50 the safety line cable 38 is threaded and doubled backed on itself and fastened to provide a termination point for the cable. It is to be noted that the pivoting upright lever 48 is flat and is located at approximately the edge of the flange of the I beam. This permits the same member to be used interchangeably no matter which end of the cable is terminated therewith.

Figure 2:
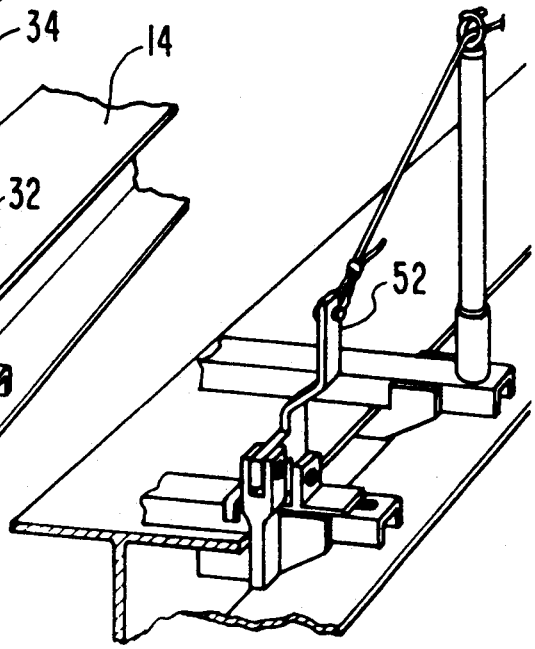
FIG. 2 is similar to FIG. 1 showing an alternative embodiment.
Figure 3:
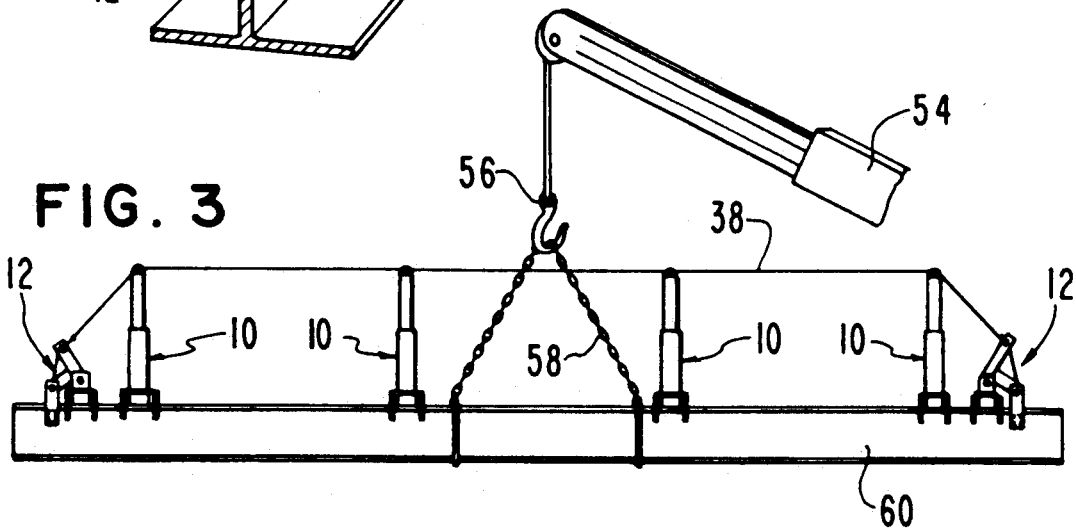
FIG. 3 is a side view of the system installed on a I beam and being lifted by an erection crane.

With reference to FIG. 2, there is shown an alternate embodiment in which the pivoting upright lever 52 is shown offset to the right. This permits a wider opening for the ironworker to use when walking the I beam but does raise the additional problem of having to have two different offset members which are not interchangeable. FIG. 2 also shows an alternate stanchion arrangement which is nonadjustable. With reference to FIG. 3 there is shown an erection crane 54 which is fastened to an I beam by means of a hook 56 and chain 58. Only the lifting arm of the erection crane is shown and this is shown in schematic form. The I beam 60 when on the ground has the 4 stanchion support clamping assemblies 10 and 2 cable termination clamping assemblies 12 and the safety line cable 38 mounted thereon. Since this arrangement does not use any of the bolt holes needed for connecting the I beam to the rest of the building structure such can be done on the ground and hoisted in position for connection to the rest of the frame work for the building, bridge or other structure. This is a far easier method than hoisting the I beam in place and attaching the safety system high in the sky.

Figure 4:
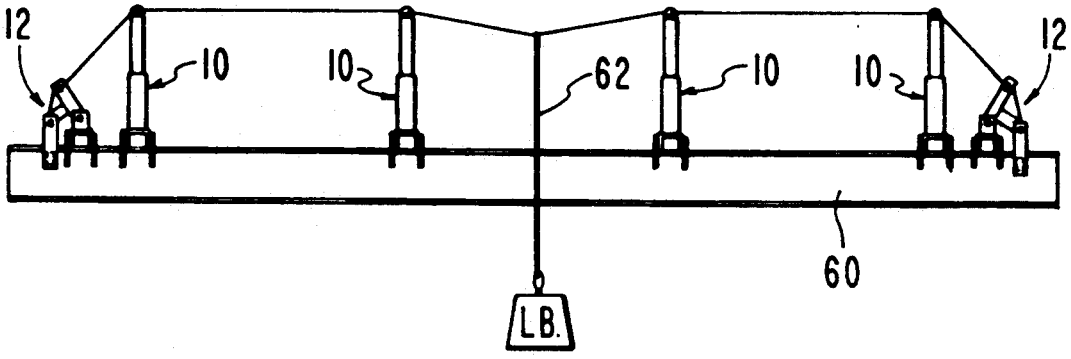
FIG. 4 is side view of the safety system showing a test weight representing a user who has accidentally fallen from the I beam.

With reference to FIG. 4, there is shown the arrangement of FIG. 3 where it is tested by dropping a 300 pound weight fastened to the safety line cable 38 by a 6' lanyard 62. This is to simulate a fall of an iron worker from the I beam and such a simulation applies great forces to the safety line cable 38 stanchion support clamping assemblies 10 and especially to the cable termination clamping assemblies 12. Yet, the invention was able to satisfactorily pass such a test.

Figure 7:
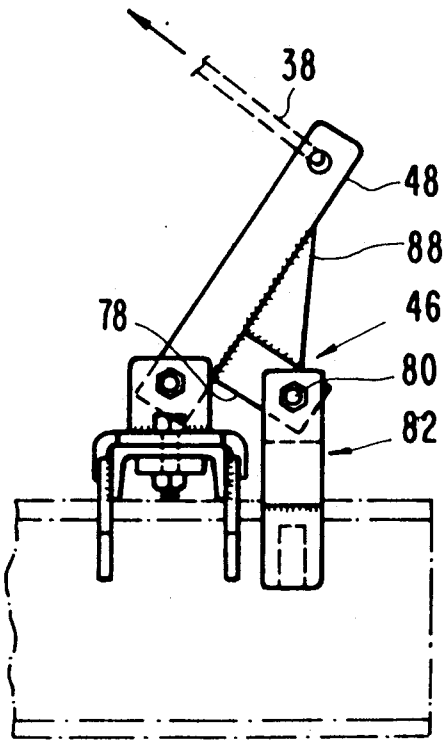
FIG. 7 is a side view of FIG. 6.
Figure 5:
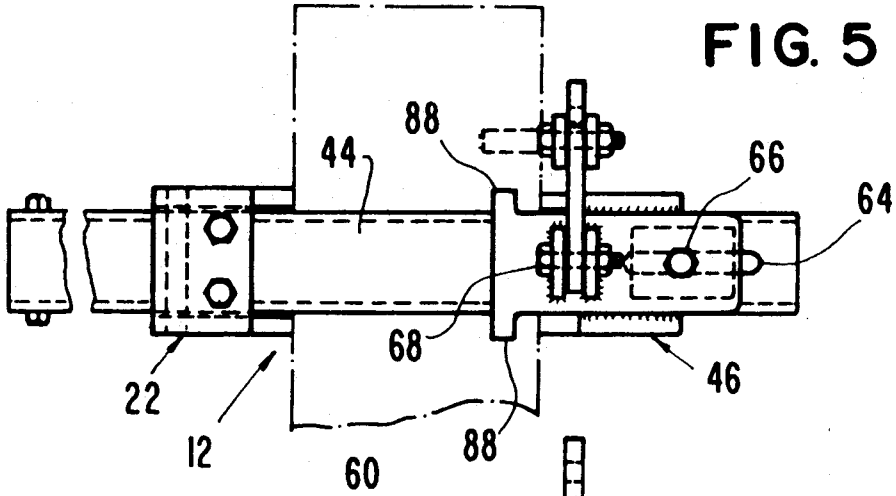
FIG. 5 is a plan view of the termination devise deployed on an I beam.
Figure 6:
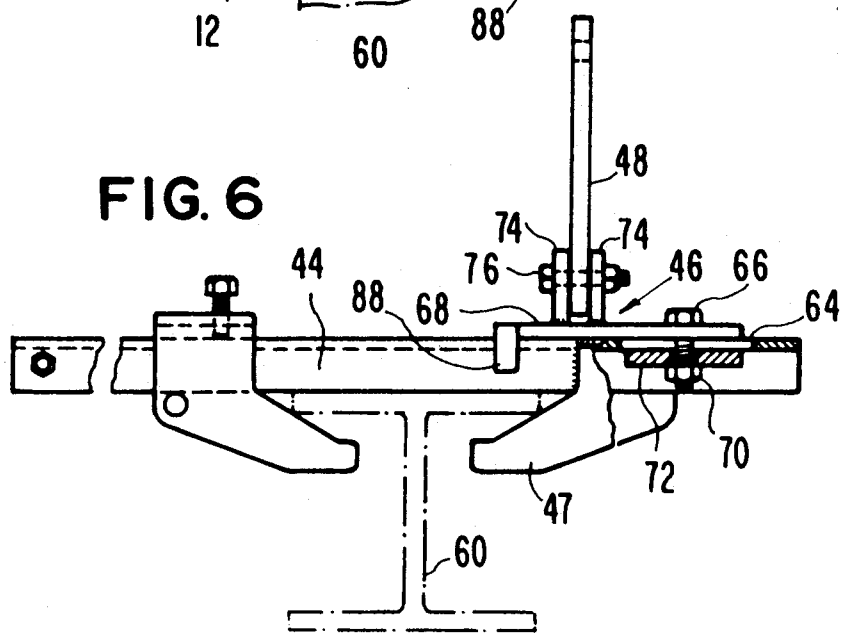
FIG. 6 is an elevational view of the termination device shown in FIG. 5 looking in a longitudinal direction of the I beam.

With reference to FIG. 5 there is shown a top view of the cable termination clamping assembly 12 which includes a slidable jaw clamping assembly 22 which has been described previously and a typical I beam 60 as well as a movable or sliding force multiplier assembly or termination clamping assembly 46. The horizontal support 44 for the termination includes a slot 64 and bolt or screw 66 having a shank slidable in the slot which runs longitudinally of the horizontal support. This bolt and slot adjustable arrangement is to permit a support plate 68 to be adjusted and fastened in position along horizontal support 44. As best seen in FIG. 6, which is a partially broken away elevational view of FIG. 5, the bolt 66 is readily fastened into a nut 70 which is welded to a slide 72. The slide is in effect a rectangular washer that bridges the slot 64. As best seen in FIG. 7, which is a side view of FIG. 6, the slide 72 is approximately the width of the opening in the horizontal support 44 so that when the screw 66 is tightened or loosened the welded nut 70 will not turn since the slide 72 is not free to turn because of its being the approximate width of the opening in the horizontal support 44. Upon being tightened the slide serves to clamp the sliding support plate 68 tightly to the upper surface of the horizontal support 44.

The sliding support 68 has 2 guides 74 riding on the outside of the vertical surfaces of the horizontal support 44 to prevent the sliding support plate from rotating when rotating forces are applied thereto. The top of the sliding support plate 68 has welded thereto a pair of pivot supports 74 extending vertically and spaced sufficiently apart to accommodate the thickness of pivoting upright lever 48. The pivot support 74 have openings therein to accommodate a pivot member 76 in the form of a bolt which passes through a coaxial hole in the lower end of the pivoting upright lever 48. Thus, the pivoting upright lever 48 is free to pivot in a vertical plane.

The sliding termination clamping assembly 46 also has a pair of clamping jaws 47 welded to each side of the horizontal support 44. The configuration of these jaws are similar to the fixed clamping jaw 16 of FIG. 1 which are utilized on the stanchion support clamping assembly 10. As seen in FIG. 6, the thickness of the flange accommodated by these jaws has been accommodated by the adjustment of the sliding termination clamping assembly 46 so the pivoting upright lever 48 is mounted approximately over the edge of the flange of the I beam 60. If the jaws had to be further separated to accommodate a thicker flange then this would place the pivoting upright lever approximately at a greater distance from the edge of the flange of the I beam. In that case, to relocate the pivoting upright lever over the edge of the flange the screw 66 would be loosened and adjusted inboard through the bolt and slot arrangement so that the pivoting upright lever would again be disposed in the vicinity of the edge of the flange and the screw would be retightened in that position. Since there are huge forces placed on the assembly, in the case of an iron worker accidentally falling, this repositioning helps to direct those forces applied to the pivoting upright lever through the safety line cable 38 so that the hook 86 and other forces are applied to the flange of the I beam with minimum distortion of the termination clamping assembly.

Figure 8:
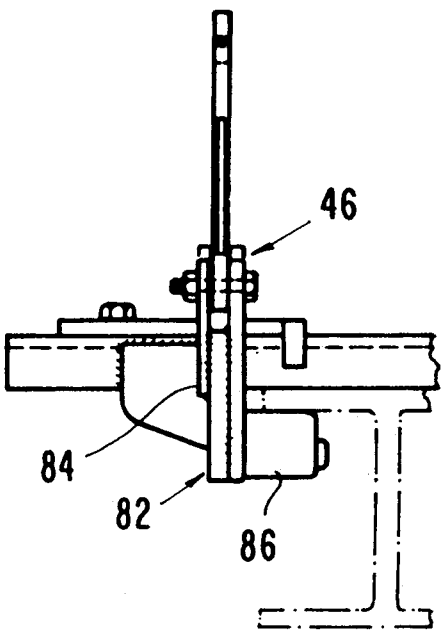
FIG. 8 is a elevational view of the right end of FIG. 5 looking from the opposite direction down the longitudinal I beam from FIG. 6.

With reference to FIG. 7, which is a side or end view of FIG. 6, and FIG. 8 which is an elevational view of FIG. 5 looking from an opposite direction of the elevational view of FIG. 6, there is shown a L-shaped hook arrangement for force multiplying or increasing the clamping forces applied to the horizontal support 44 to clamp it with increasing pressure against the top surface of the I beam. The pivoting upright lever 48 has a short lever 78 welded thereto which is pivotally mounted at 80 to a downwardly arranged L-shaped hook 82 which extends under the edge of the flange of the I beam. The hook consists of two major parts: a downwardly extending, vertically disposed plate assembly or link 84 and a horizontally extending cantilevered member or hook 86 which is welded to the plate assembly. The hook is made up of ½" thick bar stock and the plate assembly is made of ¼" thick bar stock welded to each other so that the outward plates are spaced apart to provide an opening to accommodate the short lever 78. There are holes extending through the two outer plates that line up with the hole in the outermost end of the short lever 78 to accommodate a coaxial bolt and lock nut to provide the pivot 80. The pivoting upright lever 48 and short lever 78 in addition to being welded together at their interface have a gusset 88 which is used to reinforce the assembly. Of course, the pivoting upright lever 48 and short lever 78 can be made of one piece of material having two pivot points located at the lower end and a cable attachment point located at the upper end. It is seen that the bolt and slot adjustable sliding arrangement for the sliding termination clamping assembly 46 serves to also adjust the horizontally extended cantilevered member 86 so that it is approximately as far under the edge flange as possible. This does not have to be fully under the flange but the closer the attachment point between the cantilevered member 86 and plate assembly 84 is to the edge of the flange, the stronger the relationship.

As seen best by FIG. 7, when there is a great force applied to the safety line cable 38, it serves to pivot the pivoting upright lever to the left as it rotates about pivot member 76. This serves to raise the short lever 78 and therefore its pivot point 80 which serves to raise the hook assembly 82. To offset the tension forces applied on the hook assembly 82, which are resisted by the edge of the flange of the I beam, there is a strong vertical force downward on the pivot member 76 which is translated through the pivot support 74 to the sliding support plate 68 to the horizontal support 44 to the top of the I beam 60. Thus, the clamping force between 44 and 60 is greatly increased which greatly adds to the resistance of the cable termination clamping assembly 12 to sliding and distortion at the same time great forces are applied as a result of an iron worker accidentally falling. Preferably A36 mild steel is used in constructing the invention as this particular steel is relatively easy to weld and is at the same time tough. Many other materials are also suitable.

Thus there is shown a safety system that provides a method for assembling the system while still on the ground and raising it to the erection point by cranes or similar device. At the same time the safety system provides a unique safety cable termination arrangement which through leverage using a hook or L shape member uses the force being resisted to increase the clamping surface of the termination assembly to the structural members, such as an I beam, to which it is attached.

It will be apparent from the forgoing description, the accompanying drawings and the appended claims that various modifications in the illustrative embodiment may be contemplated within the scope and spirit of the invention.

What is claimed is:

1. A safety cable termination assembly for attaching the end of a safety cable to a construction beam such as an I beam comprising:

a clamping member for attachment to said construction beam; and a force multiplier connection associated with said clamping member and adapted to be attached to a terminal end of a safety cable so that when force is applied to the safety cable the force of contact between said clamping member and a construction beam is increased.

2. The safety cable termination assembly of claim 1 wherein said clamping member is a cross member having a first end and a second end which is adapted to span the width and contact the top surface of a construction beam and which includes an opposed pair of clamping devices near said first and second end which are adapted to extend under the flange of the construction beam and hold said cross member to said top surface.

3. The safety cable termination assembly of claim 2 wherein:

said force multiplier connection is pivotally mounted on said cross member near one of the two ends thereof; said multiplier connection including a vertically extending member adapted to be connected to the terminal end of the safety cable near the upper end thereof; and a hook carried by said vertically extending member adapted to hook under the flange of said construction beam at a point beyond said cross-member whereby the cable forces causes said vertically extending member to pivot away from and pull on said hook and push downward on said cross-member to increase the clamping forces between said cross member and the top surface of the construction beam to better resist the pull on the cable.

4. The safety cable termination assembly of claim 3 wherein said hook includes a vertically extending link pivotally attached to said vertically extending member.

5. The safety cable termination assembly of claim 4 wherein said force multiplier connection pivotally mounted on said cross-member is adjustable along said cross-member so that said vertically extending member and said hook may lie approximately above the edge of the flange of the construction beam.

6. The safety cable termination assembly of claim 5 wherein:

said force multiplier connection mount comprises: a slot in said cross-member; a tightening screw riding in said slot;

a rectangular plate riding in said cross-member under said slot and having a hole therein; a nut into which said tightening screw is threaded welded to said rectangular plate under said hole;

a sliding support plate carried by said cross-member for movement over said slot and having a hole through which said tightening screw extends;

a pair of support plate guides attached to said support plate and extending down the sides of said cross-member; and a pivotal mount of the top of said support plate to which said vertically extending member is attached.

7. A safety system providing safety to construction workers comprising:

at least two stanchion support assemblies for removably clamping to the flange of a construction beam;

a safety line cable running between said stanchion support assemblies having a first terminal end and a second terminal end; and two safety cable termination assemblies for attaching one to said first terminal end and the other to said second terminal end with each of said safety cable termination assemblies including a clamping member for attachment to said construction beam and having a force multiplier connection associated with said clamping member which is attached to one of said terminal ends so that when force is applied to said safety cable the contract between said clamping member and said construction beam is increased.

8. A method for providing a safety system for construction workers comprising the following steps:

providing a construction beam such as an I beam at ground level;

mounting at least two stanchion support assemblies by removably clamping said stanchion support assemblies to said construction beam;

mounting safety cable termination assemblies to said construction beam in a removable manner located outboard of each outermost stanchion support assemblies with each cable termination assembly having a clamping member for attachment to said construction beam and a force multiplier connection associated with said clamping member having an attachment for a safety cable;

positioning a safety cable between said attachment of one safety cable termination assembly, the stanchion support assemblies and the remaining safety cable termination assembly; and hoisting said construction beam and removably installed safety system to the position it is to be attached on the construction.

* * * * *